US005867101A

United States Patent [19]

Copeland et al.

[11] Patent Number: 5,867,101

[45] Date of Patent: Feb. 2, 1999

[54] MULTI-PHASE MODE MULTIPLE COIL DISTANCE DEACTIVATOR FOR MAGNETOMECHANICAL EAS MARKERS

[75] Inventors: Richard L. Copeland; John T. Richter, both of Boca Raton; Kevin R. Coffey, Delray Beach, all of Fla.

[73] Assignee: Sensormatic Electronics Corporation, Boca Raton, Fla.

[21] Appl. No.: 794,012

[22] Filed: Feb. 3, 1997

[51] Int. Cl.[6] ..... G08B 13/14

[52] U.S. Cl. ..... 340/572; 340/551; 343/742; 361/152

[58] Field of Search ..... 340/572, 552, 340/551; 343/742, 867; 335/284; 361/149, 152, 267

[56] References Cited

U.S. PATENT DOCUMENTS

| | | | |
|---|---|---|---|
| 4,012,742 | 3/1977 | Dempsey | 343/742 |
| 4,184,163 | 1/1980 | Woodward | 343/742 |
| 4,633,250 | 12/1986 | Anderson et al. | 340/572 |
| 4,634,975 | 1/1987 | Eccleston et al. | 361/152 |
| 4,769,631 | 9/1988 | Copeland | 340/551 |
| 4,890,115 | 12/1989 | Hartings | 343/742 |
| 5,049,856 | 9/1991 | Crossfield | 340/551 |
| 5,051,726 | 9/1991 | Copeland et al. | 343/742 |
| 5,061,941 | 10/1991 | Lizzi et al. | 340/572 |
| 5,142,292 | 8/1992 | Chang | 343/742 |
| 5,341,125 | 8/1994 | Plonsky et al. | 340/572 |
| 5,469,142 | 11/1995 | Bergman et al. | 340/572 |
| 5,493,275 | 2/1996 | Easter | 340/572 |

OTHER PUBLICATIONS

Sensormatic®, "Speed Station® Electronic Article Surveillance System" (brochure).

*Primary Examiner*—Jeffery A. Hofsass
*Assistant Examiner*—John Tweel, Jr.
*Attorney, Agent, or Firm*—Robin, Blecker & Daley

[57] ABSTRACT

A device for deactivating a magnetomechanical electronic article surveillance marker includes first, second, third and fourth rectangular coils arranged in a two-by-two array in a common plane. Drive circuitry energizes the coils according to an operating cycle which includes three modes. In the first mode, all four coils are driven with respective alternating currents in phase with each other. In the second mode, the first and second coils are driven in phase with each other and the third and fourth coils are driven substantially in phase with each other and substantially 180° out of phase with the first and second coils. In the third mode, the first and third coils are driven in phase with each other and the second and fourth coils are driven in phase with each other and 180° out of phase with the first and third coils. Taking into account the three modes of operation, substantial magnetic fields are generated in each of three mutually orthogonal directions so that a substantial deactivation field is provided along the length of the marker to be deactivated, regardless of the direction of orientation of the marker relative to the coil array. Two-coil and quadrature-driven deactivators are also disclosed.

30 Claims, 8 Drawing Sheets

MULTI-PHASE MODE MULTIPLE COIL DISTANCE DEACTIVATOR FOR MAGNETOMECHANICAL EAS MARKERS

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk deactivates the marker by using a deactivation device provided to deactivate the marker.

Known deactivation devices include one or more coils that are energizable to generate a magnetic field of sufficient amplitude to render the marker inactive. One well known type of marker (disclosed in U.S. Pat. No. 4,510,489) is known as a "magnetomechanical" marker. Magnetomechanical markers include an active element and a bias element. When the bias element is magnetized, the resulting bias magnetic field applied to the active element causes the active element to be mechanically resonant at a predetermined frequency upon exposure to an interrogation signal which alternates at the predetermined frequency and is generated by detecting apparatus, and the resonance of the marker is detected by the detecting apparatus. Typically, magnetomechanical markers are deactivated by exposing the bias element to an alternating magnetic field of sufficient magnitude to degauss the bias element. After the bias element is degaussed, the marker's resonant frequency is substantially shifted from the predetermined frequency, and the marker's response to the interrogation signal is at too low an amplitude for detection by the detecting apparatus.

One deactivator device commercially provided by the assignee hereof employs a housing having an open side with a plastic bucket inserted in the housing such that an article or a plurality of articles may be placed in the bucket. Three coil pairs are disposed about the bucket in respective x-, y- and z-axis planes, whereby a strong demagnetization field is generated inside the bucket in each of the three orientations. In this device, the deactivation field is generated in the form of a pulse generated in response to the checkout clerk actuating a switch. Because of the three orthogonal coils provided in this device, effective deactivation occurs regardless of the orientation of the marker.

The assignee hereof commercially provides a second deactivation device that is manufactured at a lower cost than the first device and is easier to operate in connection with relatively large articles of merchandise. The second type of deactivator, sometimes referred to as a "pad" deactivator, employs one planar coil disposed horizontally within a housing. Articles of merchandise bearing markers are moved across the horizontal top surface of the housing. The pad deactivator includes detection circuitry with operates continuously or virtually continuously to detect the presence of markers and to briefly energize the deactivation coil on occasions when a marker is detected. A deactivator of this type is disclosed in U.S. Pat. No. 5,341,125.

FIG. 1 shows, somewhat schematically, a plan view of a deactivation coil of the type used in a typical commercial embodiment of a pad deactivator. The coil 12 shown in FIG. 1 is in the form of a 4-inch square. A marker to be deactivated is swept horizontally above the coil 12. Detecting circuitry (not shown) detects the presence of the marker, and triggers drive circuitry (also not shown) which temporarily energizes the coil 12 with an alternating current to form a deactivation field. The marker must be swept over the coil slowly enough so that the marker is detected and the coil energized before the marker leaves the vicinity of the coil.

A difficulty encountered with the coil arrangement shown in FIG. 1 is the variation in the effective peak demagnetization field amplitude experienced by the marker to be deactivated, depending upon the orientation of the marker as it is swept over the deactivation coil 12. The coil 12 provides the strongest magnetic field in the Z direction, which is the direction orthogonal to the plane of the coil 12. The magnitudes of the peak fields in the X and Y directions (parallel to the plane of the coil as indicated in FIG. 1) are substantially lower. FIG. 2 illustrates peak magnetic fields generated by the coil of FIG. 1, as a function of distance above the coil, when the coil is excited at a level of about 15,200 Amp-Turns (A-T) Curve 14 represents the Z direction field, as it varies with distance above the coil, while curve 16 indicates the lateral direction (X or Y direction) peak field, as it varies with distance above the coil.

It can be seen from FIG. 2 that the peak magnetic field in the Z direction is substantially greater than the lateral direction field at points 1 cm or more above the coil.

In one conventional variety of magnetomechanical EAS marker, the biasing element is formed as a 12.5 mm wide strip of a semi-hard magnetic material designated as "Semi-Vac 90", available from Vacuumschmelze, Hanau, Germany. When the length of the marker is aligned with the direction of the magnetic field, a peak field level of about 100 Oe suffices to degauss the biasing element enough to deactivate the marker. However, if the length of the marker is transverse to the field direction, a peak field level of about 200 to 300 Oe is required to deactivate the marker due to the increased demagnetization factor which occurs in this situation.

Referring again to FIG. 1, the coil 12 has branches 18 and 20 running in the Y direction and branches 22 and 24 running in the X direction. Current passing through the Y-direction branches 18 and 20 generates magnetic field components in the Z and X directions; similarly, current passing through the X-direction branches 22 and 24 generates magnetic field components in the Z and Y-directions. If a marker is oriented with its length parallel to the Y direction and is swept over the coil 12 along the locus indicated by the X axis in FIG. 1, then the dominant magnetic field components applied to the marker are substantially transverse to the marker length. Such is also the case with respect to a marker oriented with its length in the X direction and swept along the Y-axis locus. Since a 300 Oe transverse field is required for reliable deactivation, FIG. 2 indicates that the marker should not be swept at more than about 10 cm above the coil if deactivation is to be assured. It will be noted that at 10 cm there is a peak Z direction field of about 300 Oe, which would be transverse to a horizontally oriented marker.

Another conventional marker is only about 6 mm wide, and would require a field strength of about 600 Oe for reliable deactivation by a transverse field.

Furthermore, because of the high field level required for reliable deactivation, it is not feasible to continuously energize the deactivation coil, so that the prior art devices, as indicated before, are operated to generate the deactivation field only in occasional, short pulses initiated by user input or upon detection of a marker.

The difficulties in assuring that a sufficiently strong deactivation field is applied to the marker are exacerbated by the increasingly popular practice of "source tagging," i.e., securing EAS markers to goods during manufacture or during packaging of the goods at a manufacturing plant or distribution facility. In some cases, the markers may be secured to locations on the articles of merchandise which make it difficult or impossible to bring the marker into close proximity with conventional deactivation devices.

OBJECTS AND SUMMARY OF THE INVENTION

It is a primary object of the present invention to provide improved devices for deactivating magnetomechanical EAS markers.

A more particular object of the invention is the provision of a deactivator which is easier to use than existing devices.

A still more specific object of the invention is to provide a device which reliably deactivates an EAS marker presented at a greater distance from the deactivation device than has previously been practical.

It is another object of the invention to provide a deactivation device that operates substantially without sensitivity to label orientation.

It is still a further object of the invention to provide deactivation devices that operate at lower power levels than conventional devices.

Yet a further object of the invention is to provide deactivation devices at lower cost than conventional devices.

According to an aspect of the invention, there is provided a method of deactivating a magnetomechanical electronic article surveillance marker including the steps of providing two conductive loops in proximity to each other, further energizing the loops on a plurality of first occasions to induce in the loops respective alternating currents that are substantially in phase with each other, second energizing loops on a plurality of second occasions, different from the first occasions, to induce in the loops respective alternating currents that are substantially 180° out of phase with each other, and, during a period of time that corresponds to at least one of the first occasions and at least one of the second occasions, sweeping the magnetomechanical marker in proximity to the energized loops to demagnetize a bias element included in the marker. According to an embodiment of the invention, there may be about four of the first occasions and four of the second occasions during each second. Preferably the loops are substantially planar and are arranged in a common, horizontally oriented plane, and the marker is swept above the common plane. The marker may be swept at a distance of up to 6 to 12 inches above the common plane.

According to another aspect of the invention, there is provided a method of deactivating a magnetomechanical electronic article surveillance marker, including the steps of providing a first conductive loop and a second conductive loop in proximity to each other, energizing the first loop to induce therein a current which alternates at a predetermined frequency, and simultaneously energizing a second loop to induce therein a current which alternates at the same predetermined frequency but at a phase offset of substantially 90° relative to the alternating current in the first loop, and sweeping the magnetomechanical marker in proximity to the energized loops to demagnetize a bias element included in the marker.

According to another aspect of the invention there is provided a method of deactivating a magnetomechanical electronic article surveillance marker, including the steps of providing first, second, third and fourth rectangular, coplanar, conductive loops, the loops being arranged adjacent each other in a two-by-two array, the first loop in an upper left-hand position in the array, the second loop in an upper right-hand position in the array, the third loop in a lower left-hand position in the array and the fourth loop in a lower right-hand position in the array, the method further including first energizing the first and fourth loops on a plurality of first occasions to induce in the first and fourth loops respective alternating currents that are substantially 180° out of phase with each other, second energizing the second and third loops on a plurality of second occasions, different from the first occasions, to induce in the second and third loops respective alternating currents that are substantially 180° out of phase with each other, and during a period of time that corresponds to at least one of the first occasions and one of the second occasions, sweeping the magnetomechanical marker in proximity to the loops to demagnetize a bias element included in the marker.

According to yet another aspect of the invention, there is provided apparatus for deactivating an electronic article surveillance marker, including two conductive loops located in proximity to each other, and drive circuitry for energizing the conductive loops, the drive circuitry operating in a first mode in a first sequence of time intervals and in a second mode in a second sequence of time intervals interleaved with the first sequence of time intervals, the drive circuitry inducing respective alternating currents in the loops that are substantially in phase with each other in the first mode and inducing respective alternating currents in the loops that are substantially 180° out of phase with each other in the second mode.

Preferably the first and second sequences of time intervals together constitute a duty cycle of at least 50%. In a preferred embodiment of the invention, each of the loops is substantially planar and rectangular, the loops are congruent to each other and each loop has a long side that is substantially twice as long as a short side of the loop, with the loops being arranged side-by-side in a common plane so as to form a substantially square array of the two loops.

The apparatus may further include a magnetic shield disposed in proximity to the loops for enhancing a field generated by each loop in a direction normal to the plane of the loop. The shield may include two planar shield members, each arranged parallel to and in proximity to a respective one of the two loops.

According to still another aspect of the invention, there is provided apparatus for deactivating an electronic article surveillance marker, including first, second, third and fourth conductive loops, each substantially planar and square and arranged in proximity to each other in a common plane so as to form a substantially square array of the four loops, with the first, second, third and fourth loops respectively corresponding to an upper left quadrant, an upper right quadrant, a lower left quadrant and a lower right quadrant of the square array; and the apparatus further including drive circuitry for energizing the conductive loops, the drive circuitry operating in a first mode in a first sequence of time intervals, in a second mode in a second sequence of time intervals interleaved with the first sequence of time intervals, and in a third mode in a third sequence of time intervals interleaved with the first and second sequences, the drive circuitry inducing respective alternating currents in all of the loops that are substantially in phase with each other in the first mode, inducing respective alternating currents in the loops in the second mode such that the alternating currents in the first and third loops are substantially in phase with each other and the alternating currents in the second and fourth loops are substantially in phase with each other and substantially 180° out of phase with the currents in the first and third loops, and inducing respective alternating currents in the loops in the third mode such that the alternating currents in the first and second loops are substantially in phase with each other, and the alternating currents in the third and fourth loops are substantially in phase with each other and substantially 180° out of phase with the currents in the first and second loops.

Apparatus and practices provided in accordance with the invention produce greater uniformity in the deactivation magnetic field and, particularly, provide substantial components in each of three mutually orthogonal directions. Accordingly, an EAS marker oriented in any one of the three orthogonal directions in the region above the coil array where the marker is likely to be passed is exposed to a substantial deactivation field in the direction of the length of the marker. Because a magnetic field is provided along the length of the marker, the peak field amplitude can be set at a lower level than in conventional pad deactivators so that the apparatus can be operated continuously, or virtually continuously, thereby eliminating the need for pulsed operation. It is therefore not necessary to provide a mechanism for detecting the presence of the marker or permitting user actuation of the deactivation field, and a simpler and lower cost deactivation device can be provided because of the lower power usage, virtually continuous operation and insensitivity to marker orientation.

The apparatus and practices according to the invention are particularly suitable for use with magnetomechanical markers employing low coercivity bias elements, as disclosed in co-pending patent application Ser. No. 08/697,629 (having a common assignee and common inventors with the present application). One of the examples of low coercivity materials disclosed in said co-pending application as suitable for use as the biasing element in a magnetomechanical marker is designated as "MagnaDur 20-4", which is commercially available from Carpenter Technology Corporation, Reading, Pa.

With magnetomechanical markers employing such biasing elements, and by applying the practices of the present invention, it is possible to reliably deactivate the markers even though the markers are swept at a greater distance from the deactivation device than was customary in accordance with the prior art.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

A first embodiment of the invention will now be described, initially with reference to FIGS. 3 and 4.

Figure 3:
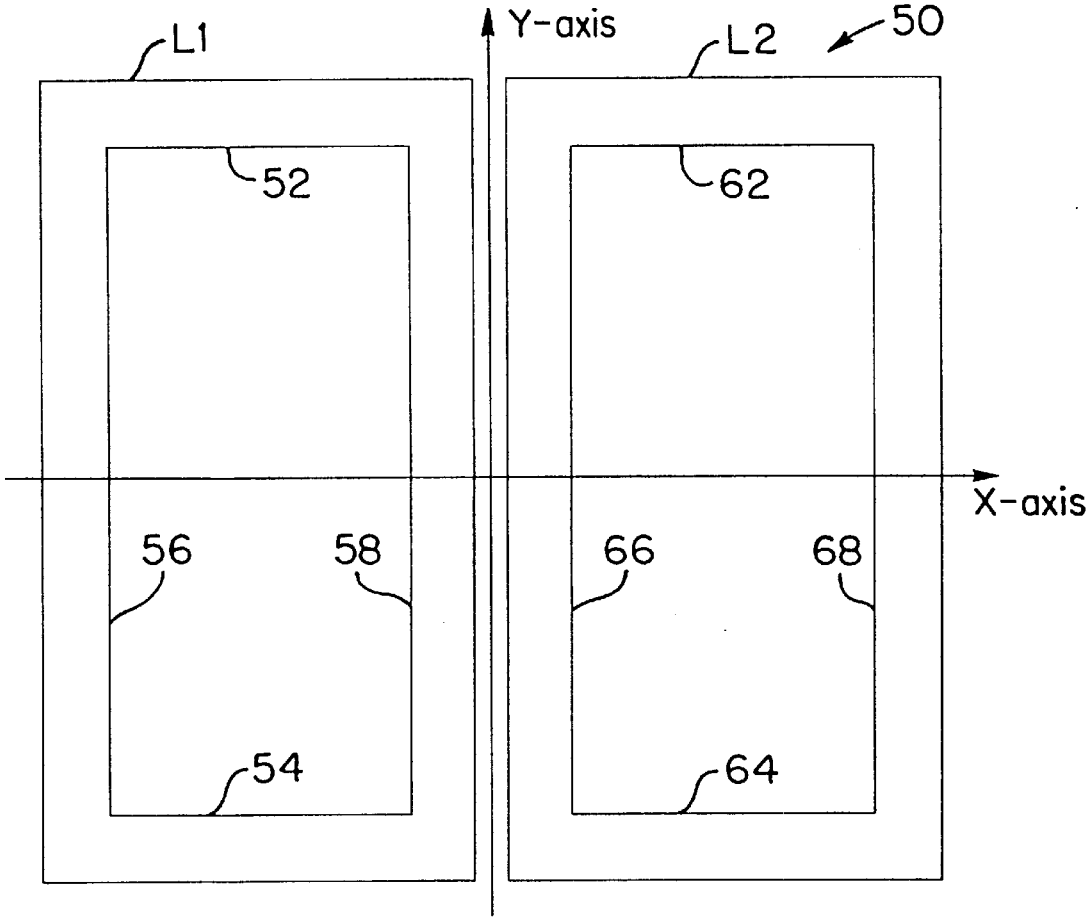
FIG. 3 is a plan view of a deactivation coil array provided in accordance with the invention.

FIG. 3 is a plan view of a deactivation coil array 50 provided in accordance with the invention. The coil array includes coils L1 and L2. The coils L1 and L2 are planar and rectangular and are each formed, in a preferred embodiment, of about 450 turns. Coil L1 has short sides 52 and 54 and long sides 56 and 58. Coil L2 is congruent to coil L1; that is, coil L2 has sides of the same length as those of coil L1, the sides of coil L2 including short sides 62 and 64 and long sides 66 and 68. Preferably the short sides are half as long as the long sides and the coils L1 and L2 are arranged long-side-to-long-side, as shown in FIG. 3, so that the coil array 50 is substantially square. In a preferred embodiment each of the coils L1 and L2 is about 6 inches by 12 inches, so that the entire area of array 50 is about 12 inches by 12 inches.

Figure 4:
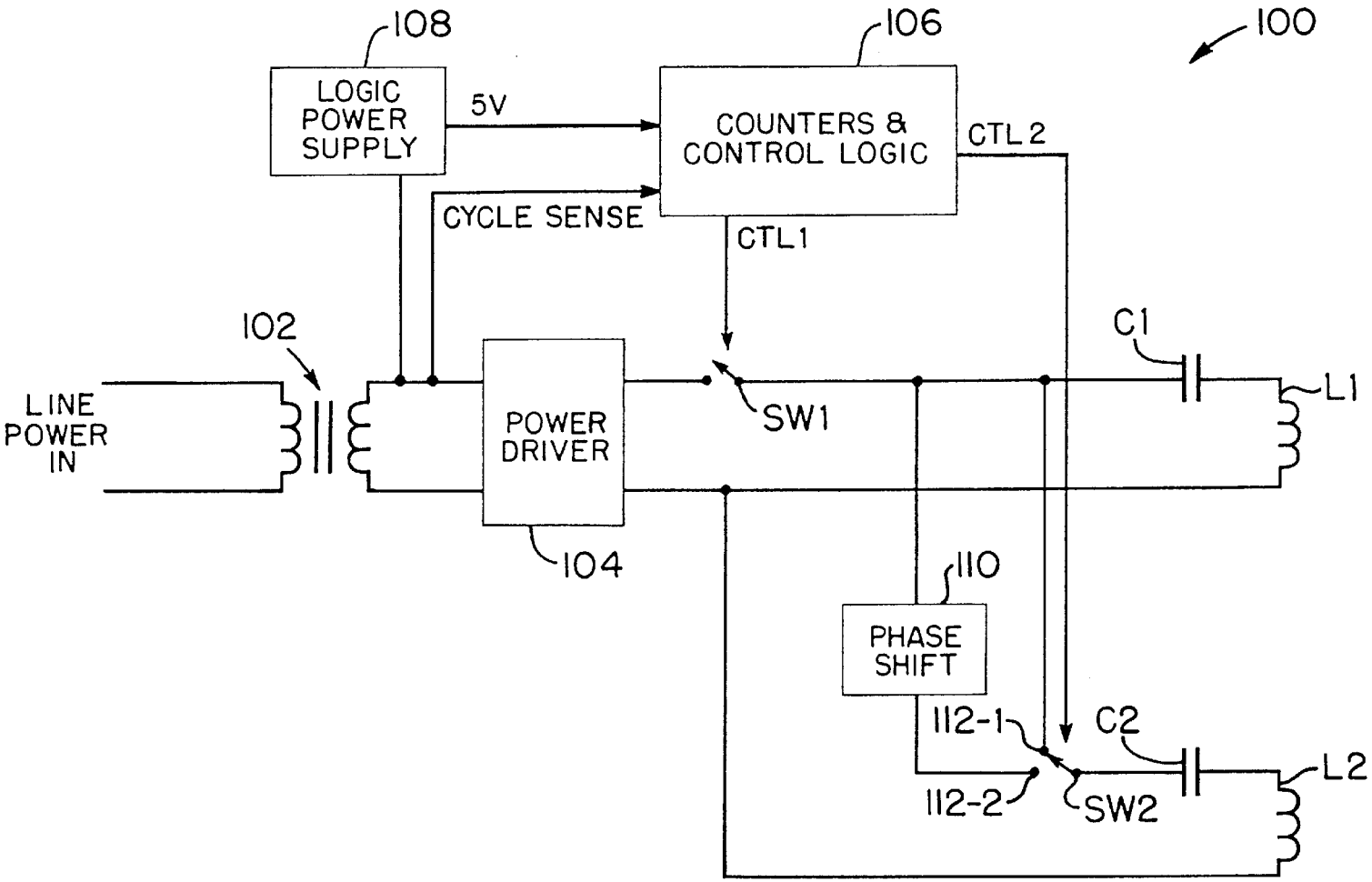
FIG. 4 is a block diagram representation of a deactivation device provided in accordance with the invention and including the coil array of FIG. 3.

FIG. 4 illustrates in block-diagram form a deactivation device 100 of which the coils L1 and L2 are a part. The deactivation device 100 includes, in addition to the coils L1 and L2, an isolation transformer 102, a power driver block 104, a counter/control logic block 106, a logic power supply 108, a phase shift block 110, switches SW1 and SW2, and capacitors C1 and C2.

Power driver 104 is connected through the transformer 102 to a conventional 60 Hz power source. When switch SW1 is in a closed condition, the power driver 104 energizes coils L1 and L2 with a 60 Hz power signal. When switch SW1 is in an open condition, coils L1 and L2 are not energized.

When switch SW1 is closed and switch SW2 is connected to its terminal 112-1, the respective 60 Hz currents in coils L1 and L2 are substantially in phase with each other. When switch SW1 is closed and switch SW2 is connected to its terminal 112-2, the phase shift block 110 is connected between switch SW1 and coil L2 and causes the 60 Hz current in coil L2 to be substantially 180° out of phase with the current in coil L1.

The switches SW1 and SW2 are controlled, respectively, by control signals CTL1 and CTL2 provided from counter/control logic block 106. Preferably the switches SW1 and SW2 are implemented using opto-isolators and triacs.

The counter/control logic block 106 operates on 5V DC converted by the logic power supply 108 from the 60 Hz input power. In addition, the counter/control logic block 106 senses zero crossings in the 60 Hz input power to drive the timings at which the switches SW1 and SW2 are controlled.

Preferably, switch SW1 is alternately opened and closed to provide an "on" duty cycle of from about 50% to about 99%. In addition, switch SW2 is controlled so that, in alternate "on" phases of switch SW1, the coils L1 and L2 are driven in phase, and in the other "on" phases of switch SW1, the coils L1 and L2 are driven in opposition.

Capacitor C1 is connected in series to coil L1 and capacitor C2 is connected in series with coil L2. The capacitors C1 and C2 provide near resonance for the coil inductance at 60 Hz. Because of the coupling between the coils, there is a difference in equivalent inductance $L_{eq}$ for each phase switching mode (additive or opposed). For the additive mode, $L_{eq}=L_s-L_m$ and for the opposed mode, $L_{eq}=L_s+L_m$, where $L_s$ is the self inductance of the each of the coils and $L_m$ is the mutual inductance between the coils. The capacitor values are set exactly for resonance at the half way point between the two modes to provide nearly equal load currents for each mode.

Figure 1:
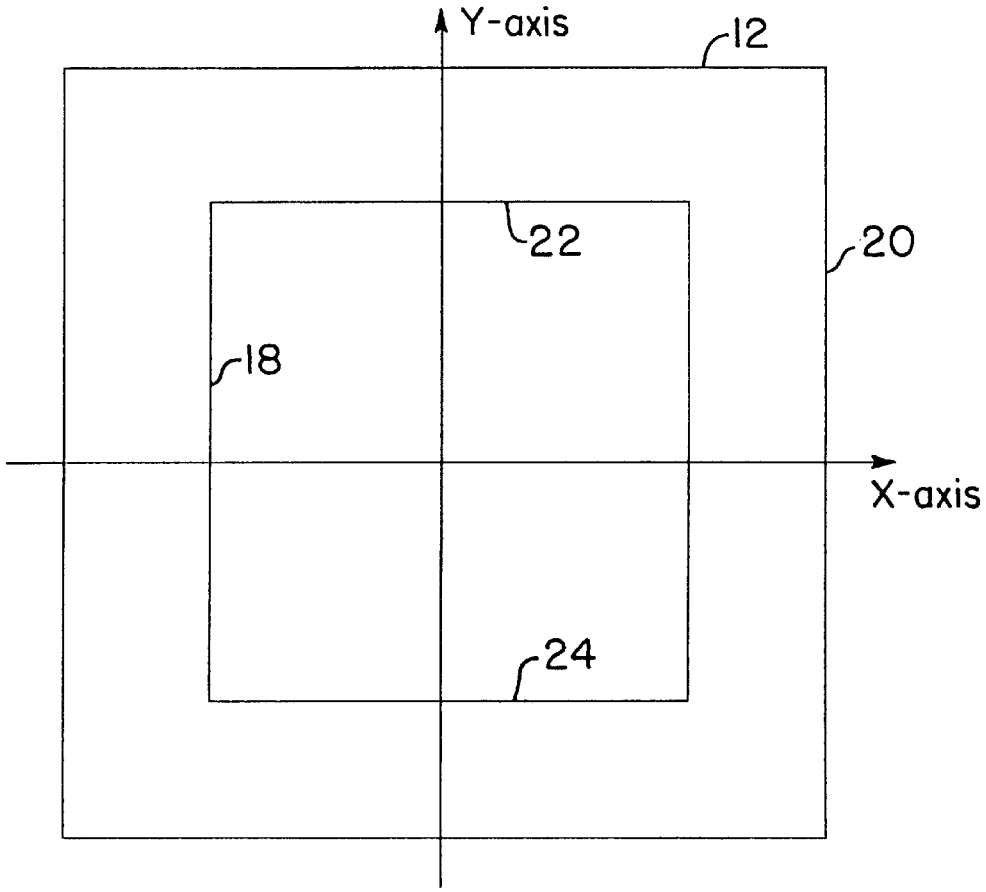
FIG. 1 (PRIOR ART)
FIG. 1 is a plan view of a coil used, according to the prior art, to generate a magnetic field for deactivating magnetomechanical EAS markers.

Referring again to FIG. 3, when the coils L1 and L2 are driven in phase, the currents in sides 58 and 66 of the coils L1 and L2, respectively, effectively cancel and the two coils together are equivalent to a single square coil having a field profile like that of the prior art activation coil 12 of FIG. 1. However, when the coils L1 and L2 are driven in opposition, the currents in sides 58 and 66 reinforce each other, and provide a strong magnetic field in the X direction.

Since the two modes are rapidly alternated, on the order of several times per second, a marker swept along the locus indicated as the Y-axis in FIG. 3 will experience a strong alternating magnetic field along its length regardless of the orientation of the marker.

Figure 5A:
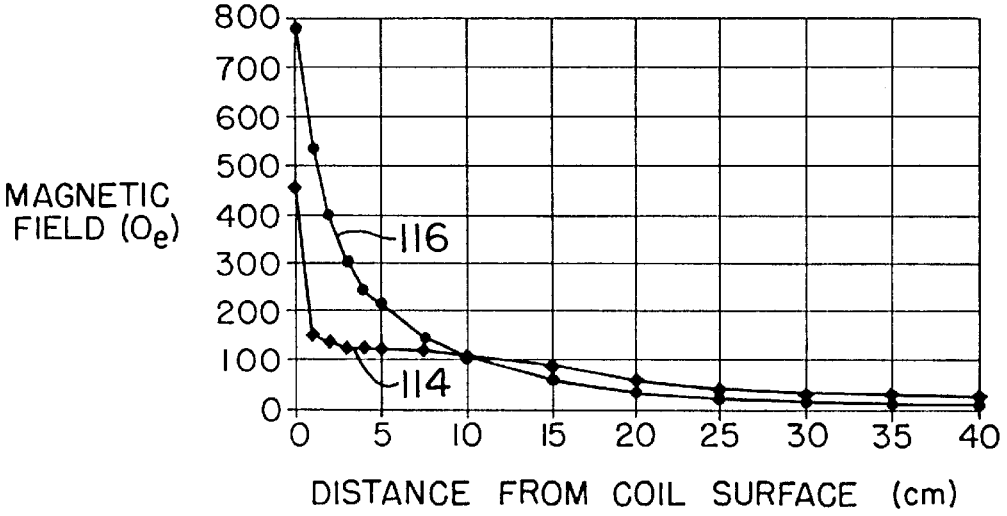
FIG. 5A is a graph representing peak magnetic field levels generated in a first mode of operation of the apparatus of FIG. 4, relative to distance above the coil array of FIG. 3.
Figure 5B:
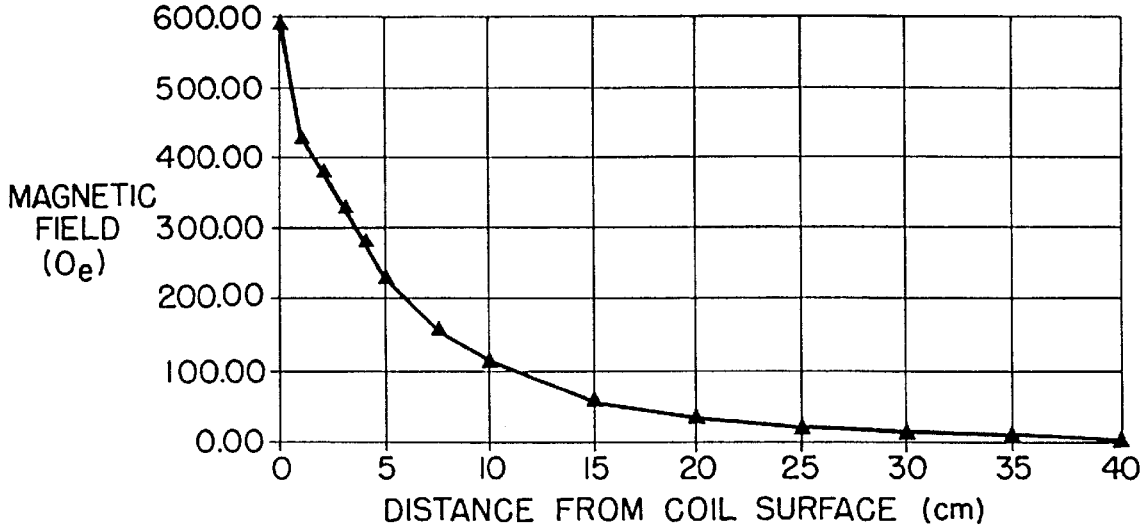
FIG. 5B is a graph of peak magnetic field levels generated in a second mode of operation of the apparatus of FIG. 4, relative to distance above the coil array of FIG. 3.

The excitation signals are provided to the coils L1 and L2 at a level sufficient to produce a peak current of about 5 to 6 A. FIG. 5A shows variations in peak magnetic field with distance from the coil surface when the deactivation device 100 is operated in its first mode (i.e., with the coils L1 and L2 being excited in phase). Specifically, curve 114 represents the peak magnetic field in the Z direction and curve 116 indicates the peak magnetic field in the Y direction. FIG. 5B shows the peak magnetic field in the X direction, as a function of distance from the coil surface, when the deactivation device 100 is being operated in its second mode, that is, with the coils L1 and L2 excited 180° out of phase with each other.

Figure 2:
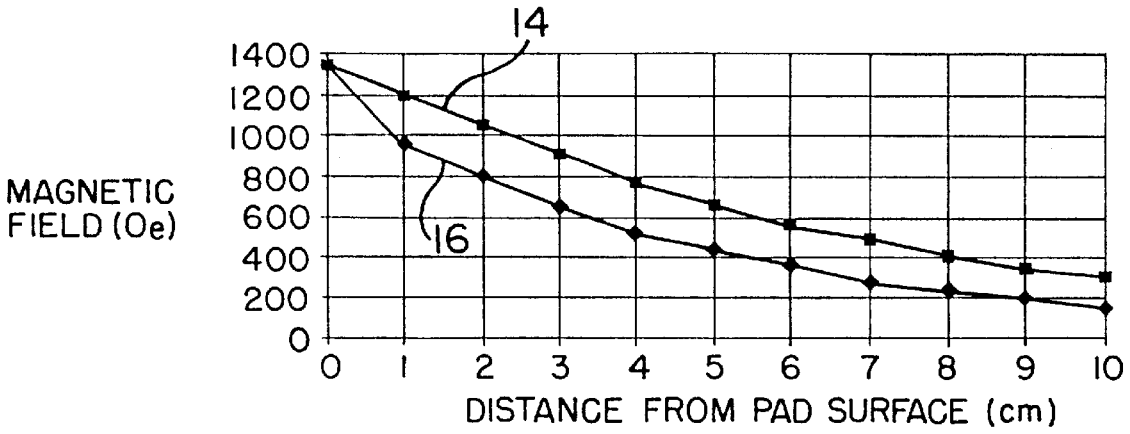
FIG. 2 (PRIOR ART)
FIG. 2 is a graph which shows peak magnetic field levels generated by the coil of FIG. 1, as a function of distance above the coil.

Since the device 100 is operated in both modes at least several times each second, it can be expected that a marker swept over coil array 50 will be exposed to a peak magnetic field oriented along the length of the label. The only exception would occur if the marker were oriented in the Y direction while being scanned along the X-axis. Barring the latter case, the field levels illustrated in FIGS. 5A and 5B are sufficient to deactivate a marker having the above-mentioned low coercivity bias element even if the marker is swept at a distance as great as about 12 inches (30 cm) above the coil array. For a marker having a conventional bias element, deactivation can be accomplished when the marker is swept at a distance up to about 4 to 5 inches above the coil array 50, notwithstanding that the field levels shown in FIGS. 5A and 5B are lower than the field levels provided by the conventional pad deactivator discussed in connection with FIGS. 1 and 2 above.

Figure 8:
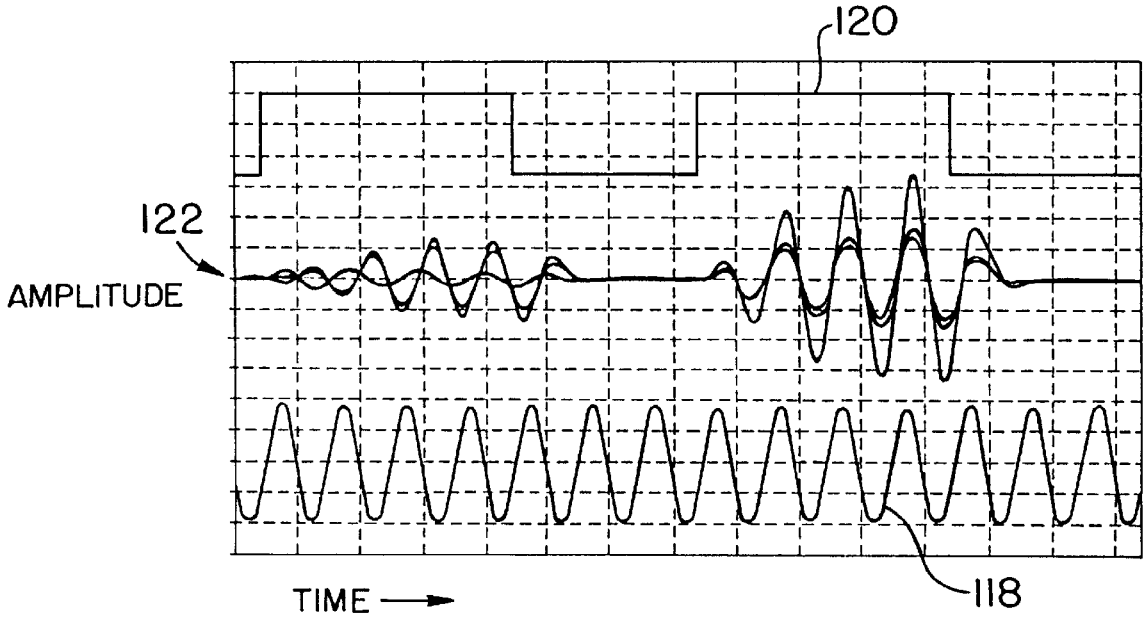
FIG. 8 shows signal traces illustrative of the first and second modes of operation of the apparatus of FIG. 4.

FIG. 8 shows signal traces which illustrate the operating cycle of the deactivation device 100. In FIG. 8, the sinusoidal trace 118 represents the 60 Hz input power signal. The square wave trace 120 represents the control signal CTL1 which controls the state of switch SW1 (FIG. 4). The higher level of the trace 120 corresponds to the closed position of switch SW1, while the lower level corresponds to the open condition of the switch. As shown by trace 120, the switch SW1 is closed for about four cycles of the power signal, then open for about three cycles, then closed for about four cycles, and so forth in a repeating pattern, to produce a duty cycle that is somewhat greater than 50%.

The three signal traces shown at 122 respectively represent the magnetic fields in the X, Y and Z directions at a given point above the coil array. On a first occasion on which the switch SW1 is closed, the coils are activated according to the first mode, then on the next occasion when the switch SW1 is closed, the coils are activated in the second mode, and the modes are thereafter alternated on succeeding occasions when the switch SW1 is closed. Consequently, both the first mode and the second mode occur about four times during each second.

In preferred embodiments of the invention, a magnetic shield is provided parallel to and underneath the coils L1 and L2 to increase the effective field above the coils and to decrease the field behind the coils. Such a shield is suitable when the deactivator device is installed on a checkout counter. The magnetic shield preferably consists of a laminated transformer sheet, having a thickness of about 6 mm. A shielding material made of pressed powdered iron, as disclosed in U.S. Pat. No. 4,769,631, may be used.

Figure 6:
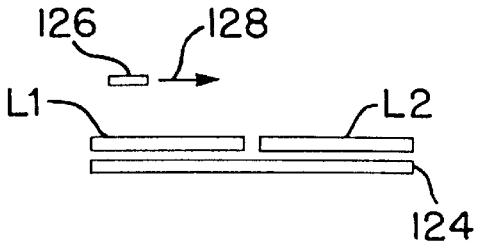
FIG. 6 is a side view of the coil array of FIG. 3, showing a shield arrangement provided according to a first embodiment of the invention.

In one configuration of the shield, shown in FIG. 6, a single shield member 124 is provided underneath the entire area of both coils L1 and L2. (Also shown in FIG. 6 is a marker 126 scanned, as indicated by arrow 128, above the coils L1 and L2).

Figure 7:
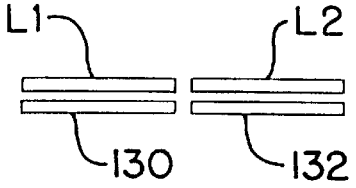
FIG. 7 is a view similar to FIG. 6, but showing a shield arrangement provided according to a second embodiment of the invention.

In another embodiment, shown in FIG. 7, separate magnetic shields 130 and 132 are provided, respectively, underneath coils L1 and L2. When separate magnetic shields are provided, as in the embodiment of FIG. 7, the co-planar coil arrangement can be adapted, if necessary, to match the geometry of the checkout counter. For example, one of the coils may be rotated by a few degrees, or even by 90°, out of the co-planar arrangement shown in FIGS. 3 and 7, and the position of the corresponding magnetic shield would also be adjusted so that each magnetic shield member remains parallel to and immediately behind its respective coil.

In another embodiment of the invention, there is provided a more uniform field distribution than in conventional deactivation devices, but without the two-mode operating cycle described above. According to this embodiment, the two-coil array of FIG. 3 is employed, and the phase relationship between the respective currents in the coils L1 and L2 is maintained at an offset of 90° at all times that the device is in operation. The device may be operated continuously or with a duty cycle in the range of 50% to 99%. Those of ordinary skill will readily appreciate how the circuitry shown in FIG. 4 can be modified to achieve the quadrature excitation of the two coils. To give one example, elements SW1, SW2, 106, 108 and 110 may all be omitted and capacitors C1 and C2 chosen so as to provide respective phase shifts of +45° and −45° in the coils L1 and L2 relative to the 60 Hz driving signal provided by driver circuit 104.

The quadrature-driven two-coil embodiment achieves the desired goal of providing substantial magnetic fields in all of the X, Y and Z directions, and can be manufactured at lower cost than the two-mode embodiment of FIG. 4. However, for a given peak field level the quadrature-driven embodiment would require more power than the two-mode embodiment, and therefore would cost more to operate and may also be more prone to undesirable heating in the coils and power circuitry.

Figure 9:
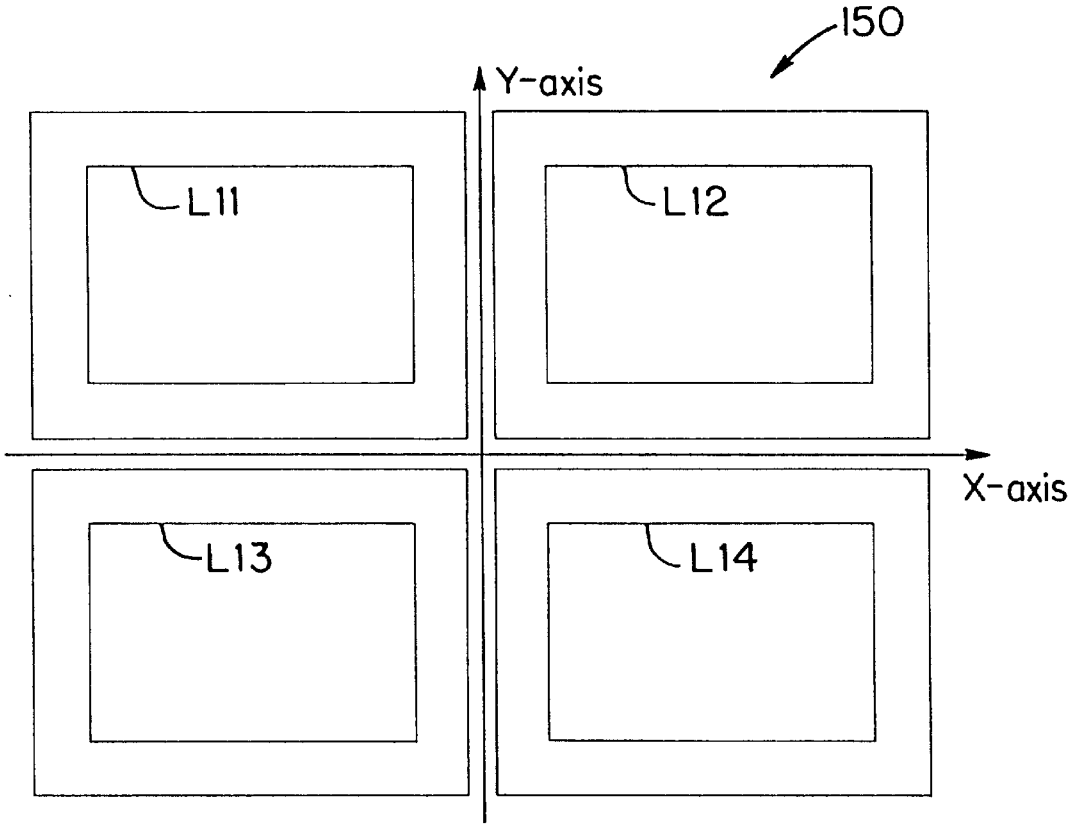
FIG. 9 is a plan view of a deactivation coil array including four coils and provided in accordance with another embodiment of the invention.

There will now be described, initially with reference to FIG. 9, a further embodiment of the invention in which four co-planar deactivation coils are employed. Specifically, FIG. 9 shows a two-by-two deactivation coil array 150, formed of coils L11, L12, L13 and L14. Preferably the coils are each about 6 inches square, providing a 12-inch square array.

Figure 10A:
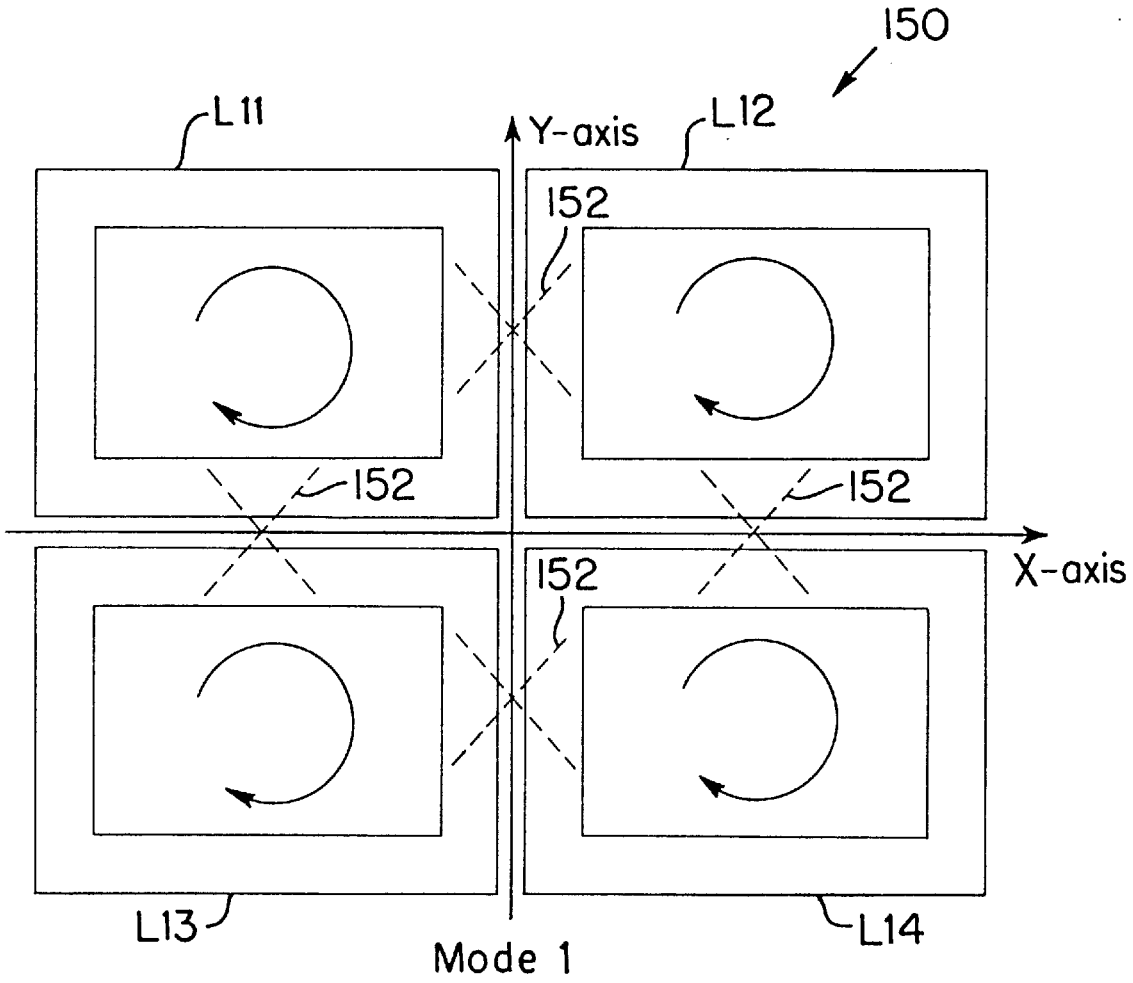
FIGS. 10A–10E schematically illustrate respective modes of energizing the deactivation coil array of FIG. 9.
Figure 10B:
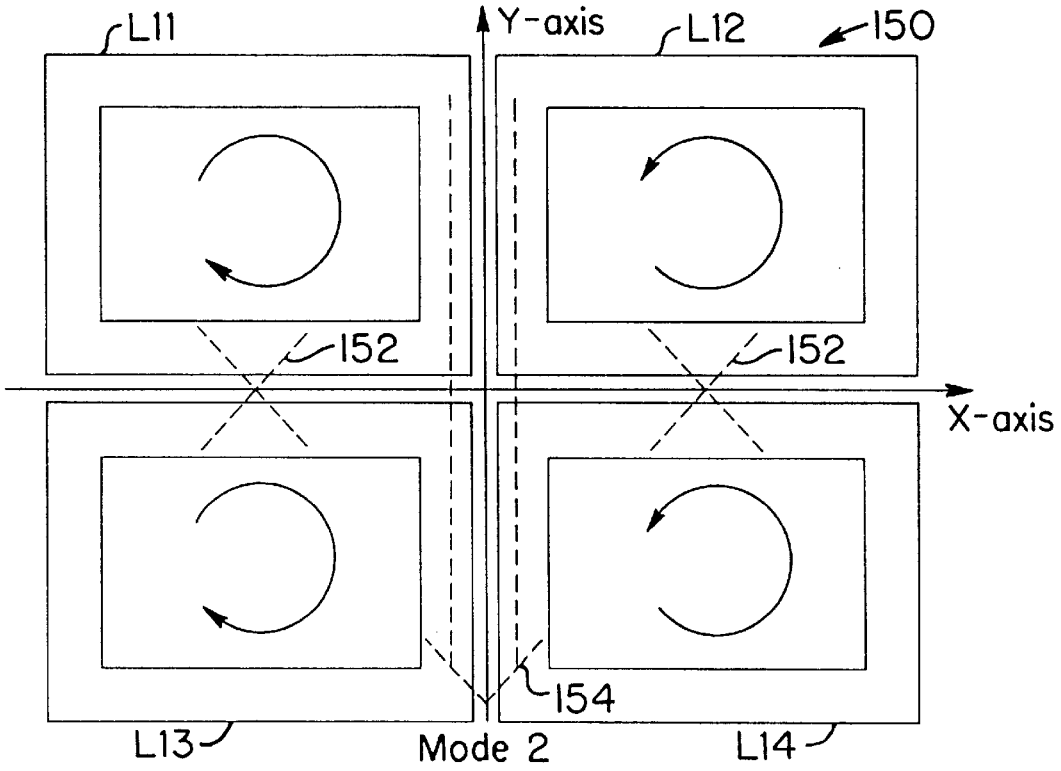
Figure 10C:
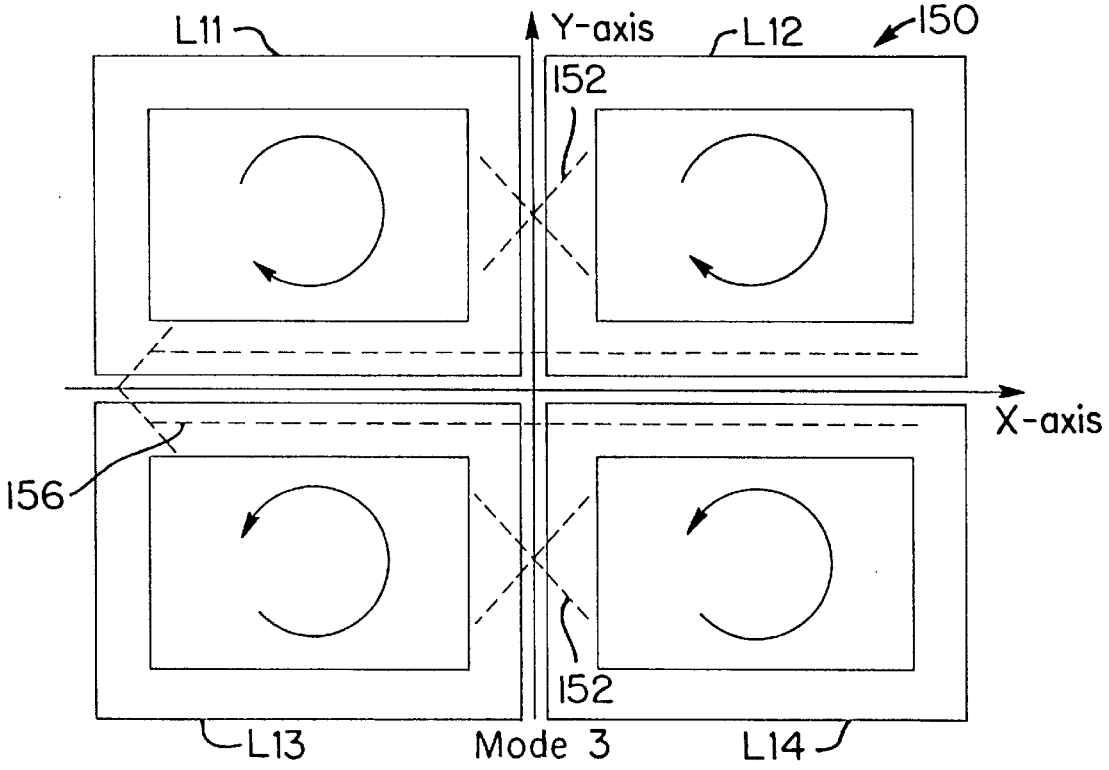

In one embodiment of the four-coil deactivator, three modes of operation are used, respectively illustrated in FIGS. 10A, 10B and 10C. In the mode of FIG. 10A, the four coils are driven in phase. The dotted-line cross-marks 152 in FIG. 10A indicate pairs of adjacent coil segments which carry opposed currents which effectively cancel each other out. In the mode shown in FIG. 10A, the coil array 150 functions so as to be essentially equivalent to a single large loop.

In the mode illustrated in FIG. 10B, coils L11 and L13 are driven in phase with each other, while coils L12 and L14 are driven in phase with each other and about 180° out of phase with coils L11 and L13. Again in FIG. 10B the cross-marks 152 represent pairs of coil segments in which opposing currents cancel each other. The dotted-line arrow 154 in FIG. 10B illustrates currents which reinforce each other, carried in respective segments of the coils which are oriented in the Y direction. The reinforcing currents in the Y-direction coil segments produce a strong peak magnetic field in the X direction.

In the mode shown in FIG. 10C, coils L11 and L12 are driven in phase with each other, and coils L13 and L14 are driven in phase with each other and substantially 180° out of phase with coils L11 and L12. Again the dotted-line cross-marks 152 indicate pairs of coil segments in which opposing currents cancel, and the dotted-line arrow 156 indicates reinforcing currents in the X direction carried in respective coil segments. The X direction currents generate a strong peak magnetic field in the Y-axis direction.

In a preferred embodiment of the invention, the four coil array is driven in an ongoing cycle of the three modes shown in FIGS. 10A through 10C and with a duty cycle of 50 to 99%. Taking the three modes into account, a strong peak magnetic field is generated in each of the X, Y and Z directions, so that a marker is exposed to a substantial magnetic field aligned with the marker's length regardless of the orientation of the marker as it is swept across the coil array. Even the case of the Y-direction oriented marker swept in the X-axis direction is satisfactorily addressed, particularly by the mode of FIG. 10C. It is to be understood that the circuitry shown in FIG. 4 may be modified to drive the four coil array of FIG. 9 in accordance with the modes of FIGS. 10A through 10C; such modification of the circuitry of FIG. 4 is well within the ability of those of ordinary skill in the art.

Figure 10D:
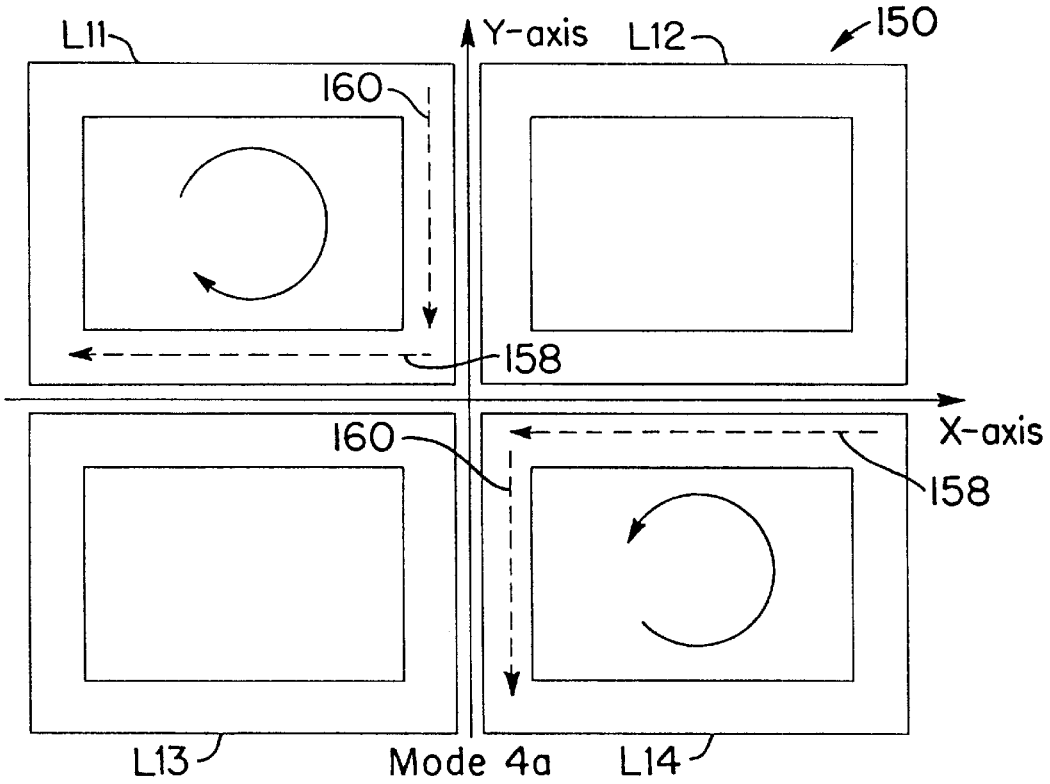
Figure 10E:
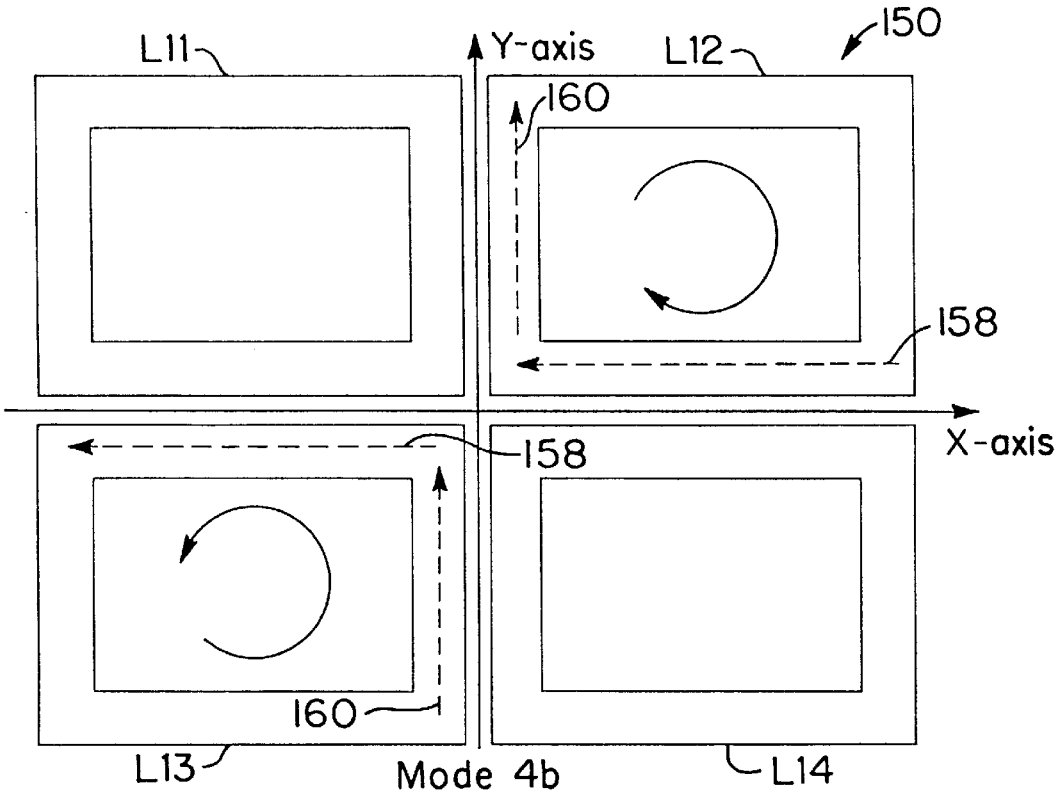

FIGS. 10D and 10E respectively show additional modes in which the four coil array of FIG. 9 may be driven. In the mode of FIG. 10D, coils L11 and L14 are driven substantially 180° out of phase with each other, and no driving signal is provided to coils L12 and L13. In the mode of FIG. 10E, coils L12 and L13 are driven substantially 180° out of phase with each other and coils L11 and L14 are not driven.

In FIG. 10D the X-direction dotted line arrows 158 represent currents carried in the X direction; these currents generate a substantial Y-direction magnetic field. Similarly, the Y-direction arrows 160 represent currents carried in respective segments of coils L11 and L14 to generate a substantial X-direction magnetic field.

Again, in FIG. 10E, the arrows 158 indicate currents carried in respective segments of coils L12 and L13 to produce a Y-direction magnetic field, and arrows 160 indicate currents which generate an X-direction magnetic field.

It can be seen that the modes of FIG. 10D and 10E both produce substantial fields in the X and Y directions. It is contemplated to drive the four coil array in a cycle which alternates between the modes of FIGS. 10D and 10E to provide X- and Y-direction fields, in addition to the Z-direction field provided in both modes, and with full coverage over all of the four coil array. Modification of the driving circuitry of FIG. 4 to provide this cycle of operation for the four coil array is again well within the ability of those of ordinary skill in the art.

With the deactivation devices disclosed herein, it is possible to reduce or eliminate reliance on a transverse magnetic field for the purpose of degaussing the bias elements of magnetomechanical markers. In other words, with the deactivation devices shown herein, a substantial magnetic field in the longitudinal direction of the marker is provided in one or more of the various modes in which the deactivation device is frequently and repeatedly operated. As a result, the peak field strength requirement may be substantially reduced in comparison to conventional pad deactivators and the deactivation device driven continuously or with a substantial duty cycle. It is therefore not necessary to include in the deactivator either detection circuitry or a mechanism which is operable by the user to trigger the coil driving circuitry. The resulting deactivation devices provided according to the invention are less expensive to manufacture and easier to use than conventional devices. Moreover, when the devices disclosed herein are used with magnetomechanical markers having the low coercivity bias elements disclosed in the aforesaid co-pending application, it is possible to achieve reliable deactivation at a greater distance from the coil than in conventional devices. This makes the deactivation devices disclosed herein more convenient to use than conventional pad deactivators.

A single-mode, quadrature-driven, four-coil embodiment of the invention is also contemplated. This embodiment employs the two-by-two coil array of FIG. 9, and all four coils are simultaneously excited with respective signals at a fixed relative phase relationship. For example, coil L12 is driven at a +90° offset from coil L11, coil L13 driven at a +180° offset from coil L11, and coil L14 driven at a +270° offset from coil L11. This embodiment may be operated continuously or with a duty cycle of 50% to 99%.

Various other changes in the foregoing deactivation devices and modifications in the described practices may be introduced without departing from the invention. The particularly preferred embodiments of the invention are thus intended in an illustrative and not limiting sense. The true spirit and scope of the invention is set forth in the following claims.

What is claimed is:

1. A method of deactivating a magnetomechanical electronic article surveillance marker, comprising the steps of:

providing two conductive loops in proximity to each other;

first energizing said loops on a plurality of first occasions to induce in said loops respective alternating currents substantially in phase with each other;

second energizing said loops on a plurality of second occasions to induce in said loops respective alternating currents substantially 180° out of phase with each other, said second occasions being different from said first occasions; and during a period of time that corresponds to at least one of said first occasions and at least one of said second occasions, sweeping said magnetomechanical marker in proximity to said energized loops to demagnetize a bias element included in said marker.

2. A method according to claim 1, wherein said plurality of first occasions and said plurality of second occasions take place within a period of one second.

3. A method according to claim 1, wherein said loops are substantially planar and are arranged in a common, horizontally-oriented plane, and said sweeping step includes sweeping said marker above said common plane.

4. A method according to claim 3, wherein said marker is swept at a distance of at least six inches above said common plane.

5. A method of deactivating a magnetomechanical electronic article surveillance marker, comprising the steps of:

providing a first conductive loop and a second conductive loop in proximity to each other;

energizing said first loop to induce therein a current which alternates at a predetermined frequency;

simultaneously with said energizing step, energizing said second loop to induce therein a current which alternates at said predetermined frequency and at a phase offset of substantially 90° relative to the alternating current in said first loop; and sweeping said magnetomechanical marker in proximity to said energized loops to demagnetize a bias element included in said marker.

6. A method according to claim 5, wherein said loops are substantially planar and are arranged in a common, horizontally-oriented plane, and said sweeping step includes sweeping said marker above said common plane.

7. A method according to claim 6, wherein said marker is swept at a distance of at least six inches above said common plane.

8. A method of deactivating a magnetomechanical electronic article surveillance marker, comprising the steps of:

providing first, second, third and fourth rectangular, coplanar, conductive loops, said loops being arranged adjacent each other in a two-by-two array, said first loop in an upper left-hand position in the array, said second loop in an upper right-hand position in the array, said third loop in a lower left-hand position in the array, and said fourth loop in a lower right-hand position in the array;

first energizing said first and fourth loops on a plurality of first occasions to induce in said first and fourth loops respective alternating currents that are substantially 180° out of phase with each other;

second energizing said second and third loops on a plurality of second occasions to induce in said second and third loops respective alternating currents that are substantially 180° out of phase with each other, said second occasions being different from said first occasions; and during a period of time that corresponds to at least one of said first occasions and one of said second occasions, sweeping said magnetomechanical marker in proximity to said loops to demagnetize a bias element included in said marker.

9. A method according to claim 8, wherein said loops are arranged in a horizontally-oriented plane, and said sweeping step includes sweeping said marker above said plane.

10. A method according to claim 9, wherein said marker is swept at a distance of at least six inches above said plane.

11. Apparatus for deactivating an electronic article surveillance marker, comprising:

two conductive loops located in proximity to each other; and drive means for energizing said conductive loops, said drive means operating in a first mode in a first sequence of time intervals and in a second mode in a second sequence of time intervals interleaved with said first sequence of time intervals, said drive means inducing respective alternating currents in said loops that are substantially in phase with each other in said first mode, and inducing respective alternating currents in said loops that are substantially 180° out of phase with each other in said second mode;

wherein said loops are configured and arranged, and the drive means operates, so as to generate an alternating magnetic field for demagnetizing a bias element of a magnetomechanical electronic article surveillance marker, when said magnetomechanical marker is swept past said loops within a predetermined distance from said loops.

12. Apparatus according to claim 11, wherein said first and second sequences of time intervals together comprise a duty cycle of at least 50%.

13. Apparatus according to claim 11, wherein each of said loops is substantially planar and rectangular.

14. Apparatus according to claim 13, wherein said loops are congruent to each other and each loop has a long side that is substantially twice as long as a short side of the loop.

15. Apparatus according to claim 14, wherein said loops are arranged side-by-side in a common plane so as to form a substantially square array of the two loops.

16. Apparatus according to claim 15, wherein said common plane of said two loops is horizontally arranged.

17. Apparatus according to claim 11, wherein said currents alternate at 60 Hz.

18. Apparatus according to claim 11, wherein each of said loops is substantially planar; and further comprising shield means disposed in proximity to said loops for enhancing a field generated by each loop in a direction normal to the plane of the loop.

19. Apparatus according to claim 18, wherein said shield means includes two planar shield members, each arranged parallel to and in proximity to a respective one of said two loops.

20. Apparatus according to claim 18, wherein said loops are arranged in a common plane, and said shield means is a single planar member arranged parallel to and in proximity to said common plane.

21. Apparatus for deactivating an electronic article surveillance marker, comprising:

first, second, third and fourth conductive loops located in proximity to each other; and drive means for energizing said conductive loops, said drive means operating in a first mode in a first sequence of time intervals, in a second mode in a second sequence of time intervals interleaved with said first sequence of time intervals, and in a third mode in a third sequence of time intervals interleaved with said first and second sequences, said drive means inducing respective alternating currents in all of said loops that are substantially in phase with each other in said first mode, said drive means inducing respective alternating currents in said loops in said second mode such that the alternating currents in the first and third loops are substantially in phase with each other, and the alternating currents in said second and fourth loops are substantially in phase with each other and substantially 180° out of phase with the currents in the first and third loops, said drive means inducing respective alternating currents in said loops in said third mode such that the alternating currents in said first and second loops are substantially in phase with each other, and the alternating currents in said third and fourth loops are substantially in phase with each other and substantially 180° out of phase with the currents in the first and second loops.

22. Apparatus according to claim 21, wherein said first, second, third and fourth loops are all substantially planar and square and are arranged in a common plane so as to form a substantially square array of loops.

23. Apparatus according to claim 22, wherein said first loop corresponds to an upper left quadrant of said square array, said second loop corresponds to an upper right quadrant of said square array, said third loop corresponds to a lower left quadrant of said square array, and said fourth loop corresponds to a lower right quadrant of said square array.

24. Apparatus for deactivating an electronic article surveillance marker, comprising:

two conductive loops located in proximity to each other; and drive means for energizing said conductive loops, said drive means inducing respective alternating currents in said loops such that the alternating currents are substantially 90° out of phase with each other;

wherein said loops are configured and arranged, and the drive means operates, so as to generate an alternating magnetic field for demagnetizing a bias element of a magnetomechanical electronic article surveillance marker, when said magnetomechanical marker is swept past said loops within a predetermined distance from said loops.

25. Apparatus according to claim 24, wherein said loops are substantially planar and rectangular and are arranged in a common plane.

26. Apparatus according to claim 25, wherein said common plane of said two loops is horizontally arranged.

27. Apparatus for deactivating an electronic article surveillance marker, comprising:

first, second, third and fourth rectangular, coplanar, conductive loops, said loops being arranged adjacent each other in a two-by-two array, said first loop in an upper left-hand position in the array, said second loop in an upper right-hand position in the array, said third loop in a lower left-hand position in the array, and said fourth loop in a lower right-hand position in the array;

drive means for energizing said loops, said drive means operating in a first mode in a first sequence of time intervals, and in a second mode in a second sequence of time intervals interleaved with said first sequence of time intervals, said drive means inducing in said first and fourth loops, in said first mode, respective alternating currents that are substantially 180° out of phase with each other, and said drive means inducing in said second and third loops, in said second mode, respective alternating currents that are substantially 180° out of phase with each other.

28. Apparatus according to claim 27, wherein said second and third loops are not energized in said first mode and said first and fourth loops are not energized in said second mode.

29. Apparatus for deactivating a magnetomechanical electronic article surveillance marker, comprising:

a first coil;

a second coil in proximity to said first coil;

drive means for energizing said coil, said drive means operating in a first mode in a first sequence of time intervals, and in a second mode in a second sequence of time intervals interleaved with said first sequence of time intervals, said drive means driving said first coil with an alternating current in said first mode and driving said second coil with an alternating current in said second mode;

wherein said second coil is not driven in said first mode and said first coil is not driven in said second mode.

30. A method of deactivating a magnetomechanical electronic article surveillance marker, comprising the steps of:

providing a first coil;

providing a second coil in proximity to said first coil;

first energizing said first coil on a plurality of first occasions to induce in said first coil an alternating current;

second energizing said second coil on a plurality of second occasions to induce in said second coil an alternating current, said second occasions being different from said first occasions; and during a period of time that corresponds to at least one of said first occasions and at least one of said second occasions, sweeping said magnetomechanical marker in proximity to said coils to demagnetize a bias element included in said marker.

* * * * *